US006547654B2

(12) United States Patent
Del Raso

(10) Patent No.: US 6,547,654 B2
(45) Date of Patent: Apr. 15, 2003

(54) AUTOMATIC ABRASIVE SLEEVE TIGHTENING MEANS AND QUICK RELEASE SYSTEM FOR AN OSCILLATING SPINDLE SANDER

(76) Inventor: Americo Del Raso, 21858 River Oaks Dr., Rocky River, OH (US) 44116

( * ) Notice: Subject to any disclaimer, the term of this patent is extended or adjusted under 35 U.S.C. 154(b) by 0 days.

(21) Appl. No.: 09/909,935

(22) Filed: Jul. 21, 2001

(65) Prior Publication Data

US 2002/0013126 A1 Jan. 31, 2002

Related U.S. Application Data

(60) Provisional application No. 60/220,214, filed on Jul. 22, 2000.

(51) Int. Cl.[7] ..... B24B 23/02

(52) U.S. Cl. ..... 451/441; 451/357; 451/358; 279/131; 279/2.1

(58) Field of Search ..... 451/441, 357, 451/358; 279/131, 2.1; 409/233

(56) References Cited

U.S. PATENT DOCUMENTS

| | | | | | |
|---|---|---|---|---|---|
| 2,686,682 | A | * | 8/1954 | Csaki | 279/51 |
| 3,252,667 | A | * | 5/1966 | Miller | 242/571.6 |
| 3,540,552 | A | * | 11/1970 | Eich | 188/77 R |
| 3,625,528 | A | * | 12/1971 | Sage | 279/131 |
| 4,172,399 | A | * | 10/1979 | Hillesheimer | 82/101 |
| 5,040,339 | A | * | 8/1991 | Warner | 451/344 |
| 5,477,709 | A | * | 12/1995 | Rowe | 68/212 |
| 5,957,765 | A | * | 9/1999 | Kimbel et al. | 451/358 |
| 6,035,474 | A | * | 3/2000 | Knibbs | 451/441 |

* cited by examiner

*Primary Examiner*—George Nguyen

(57) ABSTRACT

An automatic abrasive sleeve tightening means and quick release system for an oscillating spindle sander is disclosed, in which a flyweight assembly automatically tightens the abrasive sleeve against the sanding drum of the oscillating spindle sander, upon activation of the sander's motor, without any manual manipulation thereof, and in which a quick release system, comprised of a pin assembly is used to lock down the top washer located atop the sanding drum and is used to release said top washer quickly and efficiently.

2 Claims, 5 Drawing Sheets

AUTOMATIC ABRASIVE SLEEVE TIGHTENING MEANS AND QUICK RELEASE SYSTEM FOR AN OSCILLATING SPINDLE SANDER

RELATED APPLICATIONS

This application claims the benefit of U.S. Provisional Patent Application No. 60/220,214 filed on Jul. 22, 2000.

FIELD OF THE INVENTION

The present invention relates generally to an oscillating spindle sander. More specifically, the present invention relates to an oscillating spindle sander with an automatic abrasive sleeve tightening means and a safety release.

BACKGROUND OF THE INVENTION

As is well-known in the art, oscillating spindle sanders are commercially available and in wide use. For example, Sears Craftsman Oscillating Spindle Sander Model No. 113.225306 is typically representative of this art.

To date, oscillating spindle sanders have been developed that require manual tightening of the abrasive sleeve. This is generally done by tightening a nut over the top washer above the sanding drum. This requires additional tools and time, as well as an estimation on the part of the user with regard to whether the abrasive sleeve is tight enough, while also allowing for a risk of overtightening. Consequently, a need exists for an automatic means by which the abrasive sleeve is accurately tightened. The present invention fulfills this need.

Further, with oscillating spindle sanders in existence, if the user gets his/her hair or clothing caught in the sander, he/she is forced to try and reach either an on/off switch on the motor or to reach the power plug and disconnect the sander from its power source in order to stop the spindle shaft, sanding drum and consequently the abrasive sleeve from turning.

Further, it is recommended that users of oscillating spindle sanders, in order to be more economical, turn the abrasive sleeve around once before discarding. Often users will only spend the top half or bottom half, not the entire sleeve. Under traditional methods of changing the sleeve, however, it can be timely to remove the nut, so many users just throw the semi-used sleeve away.

Consequently, a need exists for a system that allows the user to quickly release the abrasive sleeve from turning and in turn whatever is caught, the user's hair, clothing, etc., quickly and easily. The present invention fulfills this need. Consequently a need exists for a system that, allows the abrasive sleeve to be quickly and easily removed and replaced. The present invention fulfills this need.

SUMMARY OF THE INVENTION

The present invention, the oscillating spindle sander with automatic abrasive sleeve tightening means and quick release system for an oscillating spindle sander serves to improve current oscillating spindle sanders. In most oscillating spindle sanders, the abrasive sleeve must be manually tightened. The present invention incorporates an automatic tightening means consisting in part of a flyweight assembly that works to tighten the abrasive sleeve against the sanding drum of the oscillating spindle sander as soon as the motor of the sander is activated. An alternative embodiment of the flyweight assembly is devised to convert existing oscillating spindle sanders.

The present invention also incorporates a quick release system to be used in conjunction with a standard oscillating spindle sander or with an oscillating spindle sander with the automatic abrasive sleeve tightening means disclosed herein. The quick release system is comprised of a pin assembly that is used to lock down or release the washer located on the sanding drum. When activated, the quick release system releases said washer allowing the abrasive sleeve and anything caught with it, the user's hair, clothing, etc. to loosen and quit spinning without the user having to find the on/off switch of the motor or find the electrical power plug. The pin assembly also allows for quick and easy removal and replacement of the abrasive sleeve whenever necessary.

It is an object of the present invention to provide an automatic abrasive sleeve tightening means for an oscillating spindle sander such that the user does not have to manually tighten the abrasive sleeve.

It is a further object of the present invention to provide a quick release system for an oscillating spindle sander such that if the hair, clothing, etc. of a user is caught in the oscillating spindle sander, the user can quickly release the abrasive sleeve and break free of the sander without having to reach the on/off switch on the motor, or the electrical plug, etc.

It is another object of the present invention to provide a quick release system that allows for quick and easy removal and replacement of the abrasive sleeve.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE INVENTION

Figure 1:
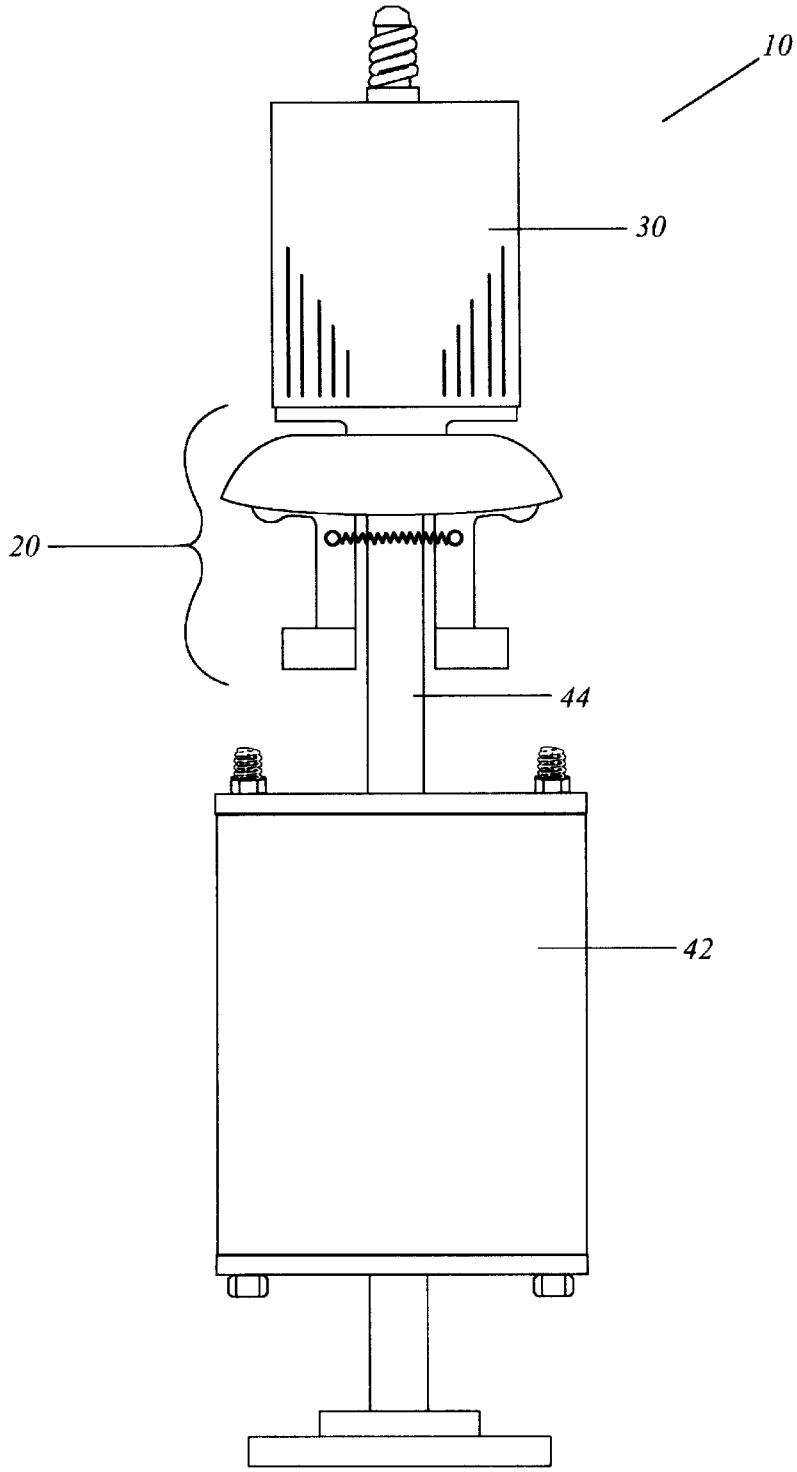
FIG. 1 is a front view of the oscillating spindle sander with automatic abrasive sleeve tightening means and a quick release system.
Figure 2:
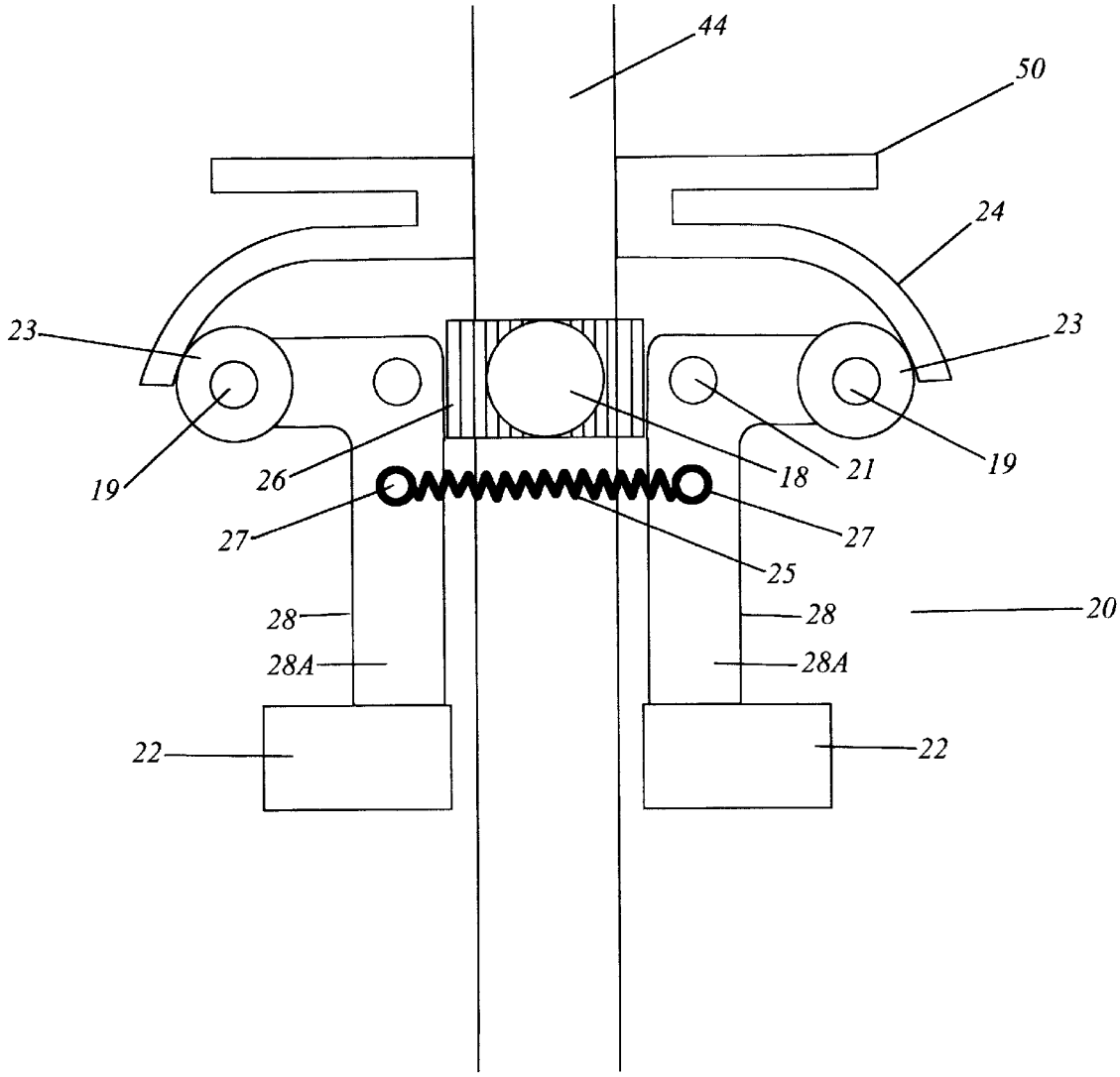
FIG. 2 is a front view of the automatic abrasive sleeve tightening means with the front half of the dome plate cut away.

An oscillating spindle sander 10 is shown in FIG. 1 with the present invention, the with abrasive sleeve tightening means 20 and quick release system. As mentioned above, the abrasive sleeve 30 on most oscillating spindle sanders is tightened manually by screwing on a nut. This action requires separate tools and requires the user to know how far to tighten the nut. The oscillating spindle sander 10 with abrasive sleeve tightening means 30 and quick release system, has a system that includes flyweights 22 to automatically tighten the abrasive sleeve 20 that fits over the sanding drum 40 as can be seen in FIG. 2.

The motor 42 causes the spindle shaft 44 to spin. Both the motor 42 and the spindle shaft 44 are of the type commonly known to one of ordinary skill in the art. Attached to the spindle shaft 44 is a spider gear 26 that is anchored to the spindle shaft 44 via a bolt, rivet or similar means 18. One of ordinary skill in the art would recognize that the spider gear 26 can also be machined directly with the spindle shaft 44. The spider gear 26 rotates with the spindle shaft 44. Dome plate 24 sits atop spider gear 26. In the preferred embodiment, the dome plate 24 does not rotate with the spindle shaft 44 and the spider gear 26. One of ordinary skill in the art would recognize that the dome plate 24 can rotate with the spindle shaft 44 and the spider gear 26 without altering its function or the intentions of the inventor. The dome plate 24 has a top flat section 50 that replaces the base washer found in most oscillating spindle sanders, as is known to one of ordinary skill in the art.

In the preferred embodiment, the two flyweights 22 are coupled to the two inverted "L"-shaped metal arms 28 that are in turn connected to the spider gear 26 via the two posts (not shown) that are connected to the spider gear 26. One of ordinary skill in the art would recognize that the number of flyweights 22 and thus the number of arms 28 and posts (not shown) can be increased depending on the length of the shaft 44. It is preferred that the flyweights 22, arms 28 and posts (not shown) are increased two at a time for even weight distribution. It is preferred that the arms 28 be connected to the posts (not shown) by a rivet at pivot point 21. One of ordinary skill in the art would recognize that the arms 28 could be connected to the posts (not shown) by other means, including, but not limited to a pin. In the preferred embodiment, the rollers 23 are connected to the arms 28 by a fastener 19 at the opposite end from the flyweights 22. The rollers 23 can be plastic, metal, etc. The rollers 23 are preferably connected to the arms 28 by a rivet, although other means can be used. The rollers 23 are preferably single rollers, but they can be double rollers or ball shaped rollers, etc. In the preferred embodiment, two springs 25, one spring 25 attached via a screw, rivet, etc. 27 to the first flat side 28*a* of arms 28, located on one side of the spindle shaft 44, and a second spring 25 attached via a screw, rivet, etc. 27, attached to the second flat side (not shown) of arms 28, located on the opposite side of the spindle shaft 44, keep the arms 28 and thus the flyweights 22 from overextending. The springs 25 also aid in the return of the flyweights 22 upon the motor 42 being turned off or the power to the motor 42 being terminated.

In the preferred embodiment, as the spindle shaft 44 rotates, centrifugal force causes the flyweights 22 to fly out in a direction away from the spindle shaft 44. As the flyweights 22 fly out away from the spindle shaft 44, the flyweights pull arms 28 out away from the spindle shaft 44. Consequently, the arms 28 pivot around pivot point 21 causing rollers 23 to roll in toward the spindle shaft 44. As the arms 28 move around pivot point 21, the rollers 23 force the dome plate 24 to move in an upward motion toward the sanding drum 40 such that the top platform 50 of the dome plate 24 pushes upward and compresses the sanding drum 40. As dome plate 24 pushes upwards on the sanding drum 40, the sanding drum 40 is compressed against top washer 60 that rotates with the spindle shaft 44 on the horizontal plane, but is prevented from moving in an upward direction either by the traditional nut, the quick release system disclosed later herein or by other means. The sanding drum 40 is made out of rubber in the preferred embodiment. It is readily known to one of ordinary skill in the art, however, that the sanding drum 40 can be made out of other materials that have properties similar to rubber in that it is strong, durable and pliant. As the sanding drum 40 is vertically compressed against top washer 60, it expands horizontally exerting pressure on the inside of the abrasive sleeve 30 that has been placed around the sanding drum 40. Both the sanding drum 40 and the abrasive sleeve 30 rotate with the spindle shaft 44 just as in any oscillating spindle sander as is known to one of ordinary skill in the art. It is preferred that the sanding drum 40 exert just enough pressure on the abrasive sleeve 30 to keep it taught against the sanding drum 40 such that the abrasive sleeve 30 does not loosen or slip when the user presses the material that needs to be sanded against the abrasive sleeve 30 while it is rotating.

In the preferred embodiment, when the oscillating sander 10 is turned off or the power to the oscillating sander 10 is cut, the motor 42 will begin to turn the spindle shaft 44 slower until it eventually stops. It is preferred that as the spindle shaft 44 turns slower, the flyweights 22 will come back in towards the spindle shaft 44 causing the rollers 23 to move away from the spindle shaft 44 and allowing the dome plate 24 to lower, thus releasing the compression on the sanding drum 40 and loosening the abrasive sleeve 30 so that it can be removed and replaced when necessary.

Figure 3:
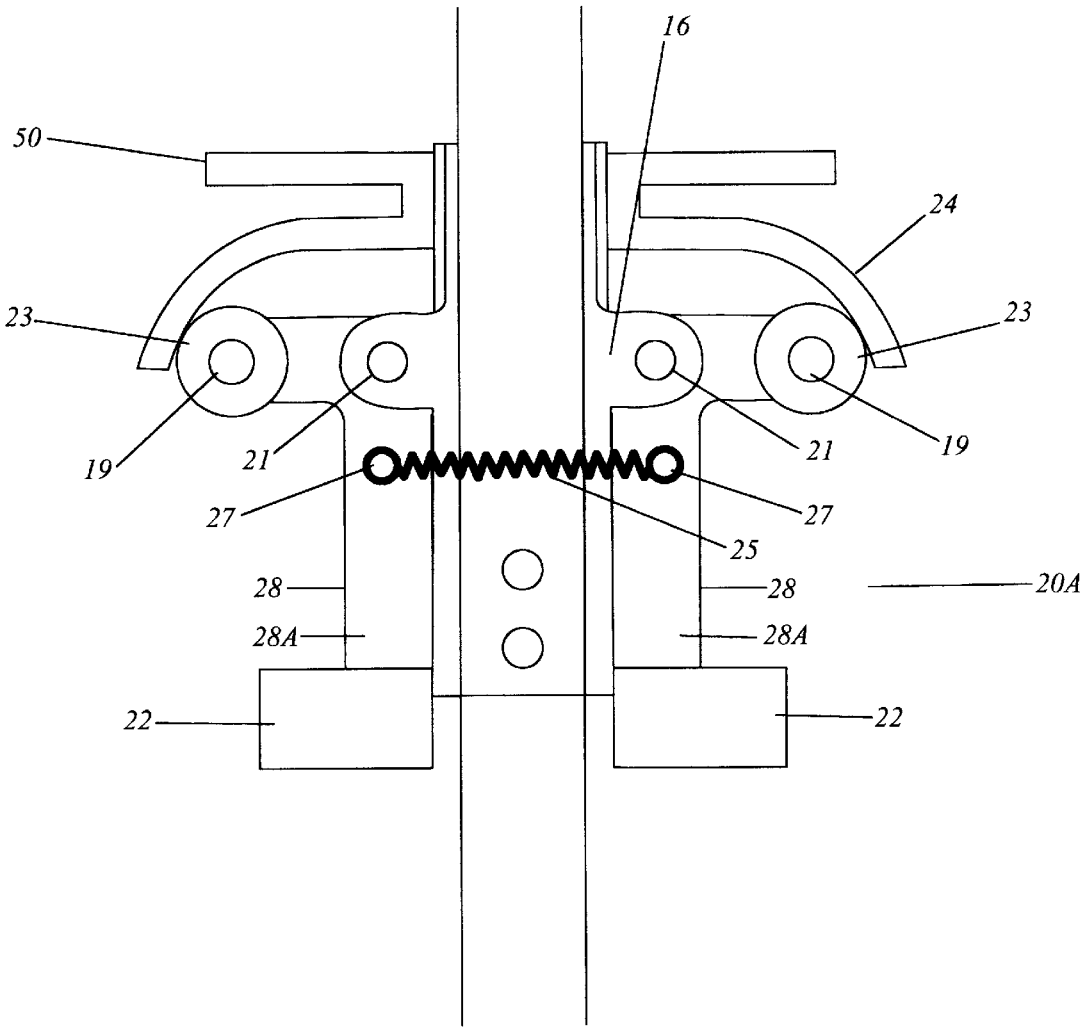
FIG. 3 is a front view of an alternative embodiment of the automatic abrasive sleeve tightening means with the front half of the dome plate cut away.

In an alternative embodiment, the abrasive sleeve tightening means 20 is adapted such that it can be fitted onto a standard oscillating spindle sander already in existence. In this alternative embodiment 20A, shown in FIG. 3, the spider gear 26 and posts (not shown) are replaced by a sheathe 16 that wraps around the spindle shaft 44. It is preferred that the sheathe 16 is fastened directly to the spindle shaft 44 via two rivets, although other fastening means could be used, and that the sheathe 16 has posts machined thereto for the arms 28 to connect to. To apply this alternative embodiment 20A to an existing oscillating spindle sander, one simply removes the sanding drum and the washers from the saner, slides the automatic abrasive sleeve tightening means 20A over the shaft, tightens the rivets or other fasteners to set the abrasive sleeve tightening means in place and replaces the sanding drum 40 and top washer 60. The bottom washer is replaced by the top platform 50 of the dome plate 24.

Figure 4:
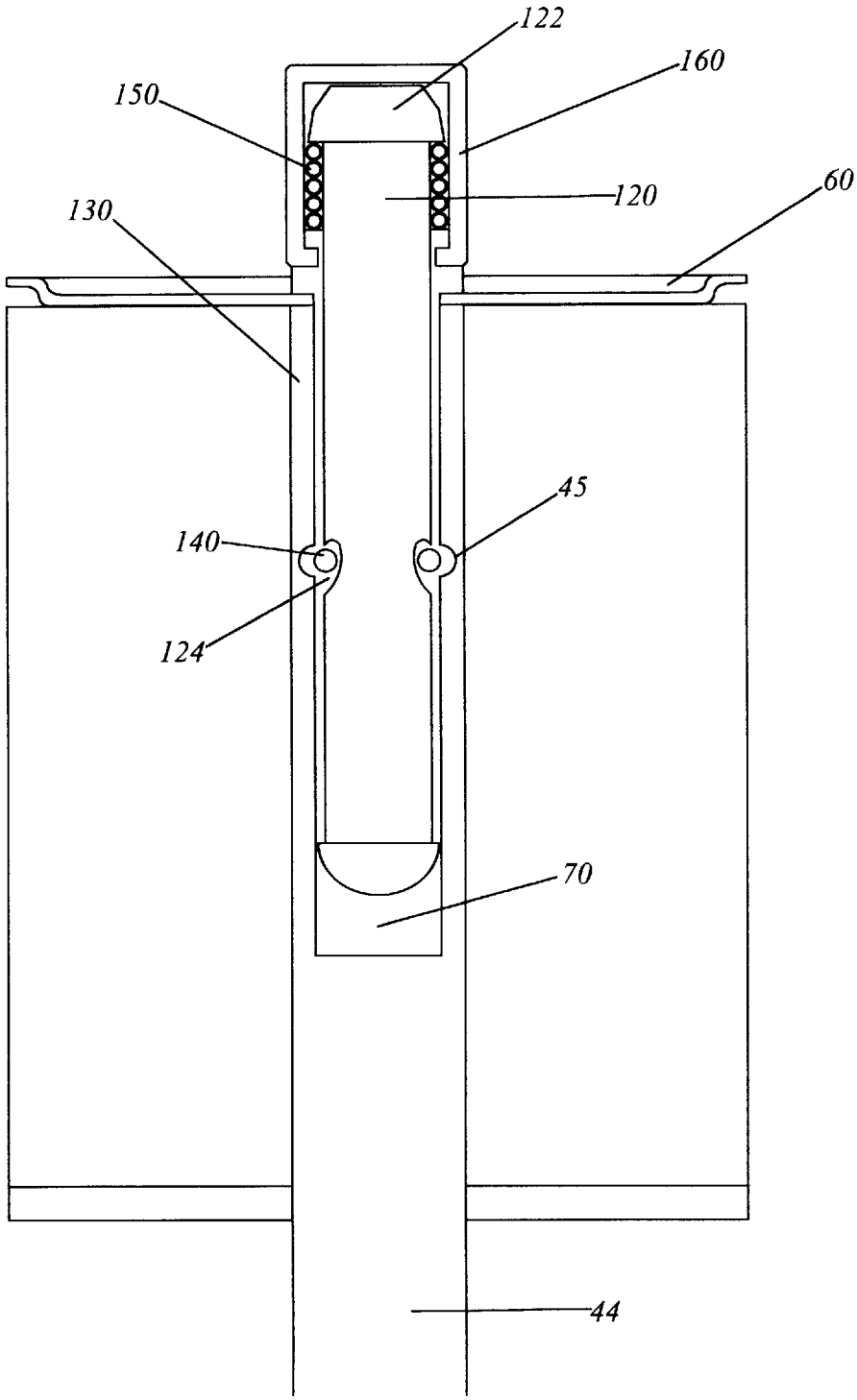
FIG. 4 is a front view of the pin assembly in a compressed position with the front half of the sanding drum, abrasive sleeve, and spindle shaft cut away.
Figure 5:
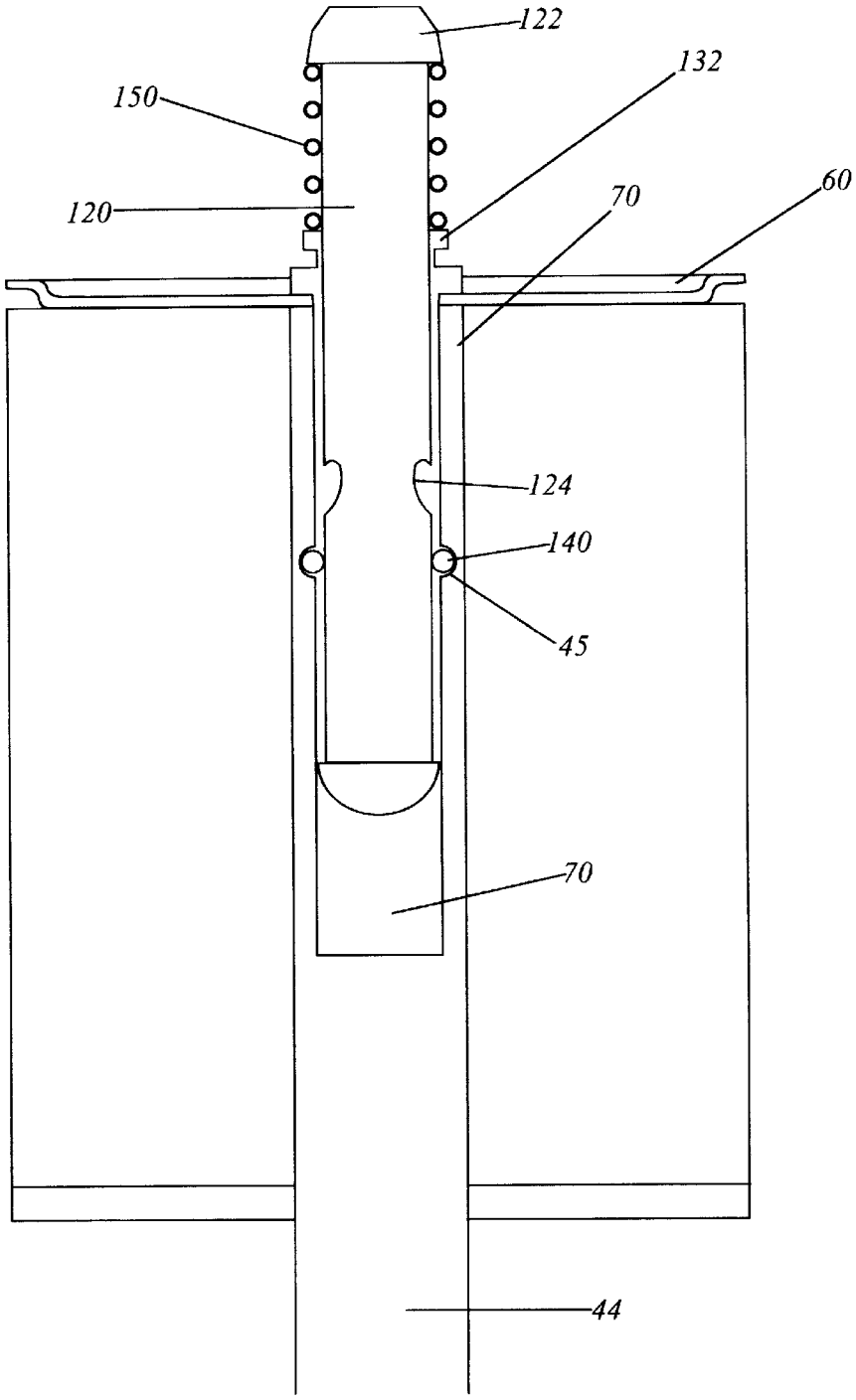
FIG. 5 is a front view of the pin assembly in a released position with the front half of the sanding drum, abrasive sleeve, and spindle cut away.

The same compression concept as detailed above, is used in the quick release system mechanism as shown in FIGS. 4 and 5. In most oscillating sanders, as known to one of ordinary skill in the art, the top washer 60 rotates with the spindle shaft 44 on the horizontal plane, but has a retaining nut, pin, etc. to limit its vertical movement. In an oscillating spindle sander having a quick release system, the top washer 60 is held in place by a pin assembly 110. In the preferred embodiment, the spindle shaft 44 has a core section thereof removed creating a cavity 70. This cavity 70 must be large enough to allow the pin assembly 110 to slide down into the spindle shaft 44, but not too large as to compromise the strength of the spindle shaft 44. In the preferred embodiment, the quick release system mechanism is comprised of the pin assembly 110, having an inner pin 120, a housing 130, a spring 150 bearings 140 and an optional lock 160. Said pin assembly 110 is called a ball locking pin, currently on the market and is known to one of ordinary skill in the art.

Within the cavity 70, in the preferred embodiment, are two openings, referred to herein as shaft openings 45, cut out of the spindle shaft 44 into the sides of the cavity 70, sized to accommodate a portion of the bearings 140. Similarly, in the pin assembly 110, two portions of the inner pin 120 are removed. These removed portions are referred to herein as pin openings 124. These pin openings 124 are sized to accommodate the bearings 140 such that only a small portion of the bearings 140 is allowed to exit the pin openings 124.

The pin assembly 110 is inserted into the cavity 70. If the user gets his/her hair, a piece of clothing, etc. caught in the spinning sander, he/she need only press down on the inner pin head 122 far enough to allow the widest portion of pin openings 124 to line up with the shaft openings 45 so that the small portion of the bearings 140 that is being held in the shaft openings 45 can slip out of the shaft openings 45 and into the pin openings 124 allowing the housing 130 to move in a very slight upward direction, away from the motor 42, slightly releasing the top washer 60, allowing the sanding drum 40 to expand vertically, thus creating a very slight release of compressive pressure from the sanding drum 40 on the abrasive sleeve 30. This process releases just enough pressure for the abrasive sleeve 30 to come loose along with the user's hair, clothing, etc. This method does not cut power to the oscillating spindle sander 10, it merely acts as a quick release for the user to get away from the oscillating spindle sander 10 before he/she is seriously hurt. When the oscillating spindle sander 10 is off, the pin assembly 110 allows the user to quickly release and change the abrasive sleeve 30.

In the preferred embodiment, the lock 160 is used to keep the inner pin 120 down so that the pin openings 124 remain in line with the shaft openings 45. When the inner pin 120 is compressed, the lock 160 is flipped up to cover the inner pin head 122 and hold the pin head 122 down. To release the inner pin 120 simply push down on the inner pin head 122, flip the lock 160 down, and release the inner pin 122.

Although this invention has certain preferred embodiments, it will be obvious to those skilled in the art that various changes and modifications may be made therein without departing from the invention, and all such changes and modifications are intended to fall within the true spirit and scope of the invention.

What is claimed is:

1. An automatic abrasive sleeve tightening means for an oscillating spindle sander comprising:

a gear, capable of fitting around the spindle shaft of an oscillating spindle sander, rigidly fastened to said spindle shaft;

at least two posts, each of said posts having a first end and a second end, each of said posts connected to said gear at the first end of said posts, crossways from another post;

at least two arms, each of said arms having a first end and a second end and each of said arms pivotally connected to the second end of one of said posts;

at least two rollers, each of said rollers coupled to the first end of one of said arms;

at least two flyweights, each of said flyweights coupled to the second end of one of said arms; and, at least one set of two springs, each said set of two springs connecting two of said arms to each other on opposite sides of the spindle shaft.

2. An automatic abrasive sleeve tightening means for an oscillating spindle sander comprising:

a sheathe, capable of fitting around the spindle shaft of an oscillating spindle sander, rigidly fastened to said spindle shaft and having a pair of posts crossways from each other;

at least two arms, each of said arms having a first end and a second end and each of said arms pivotally connected to a post of said sheathe;

at least two rollers, each of said rollers coupled to the first end of one of said arms;

at least two flyweights, each of said flyweights coupled to the second end of one of said arms; and, at least one set of two springs, each said set of two springs connecting two of said arms to each other on opposite sides of the spindle shaft.

* * * * *